United States Patent [19]

Wilson et al.

[11] 4,016,705

[45] Apr. 12, 1977

[54] METHOD AND APPARATUS FOR PURGING AIR FROM CONTAINERS

[75] Inventors: Donald C. Wilson; Samuel A. Mencacci, both of San Jose; Jurgen H. Strasser, Mountain View, all of Calif.

[73] Assignee: FMC Corporation, San Jose, Calif.

[22] Filed: Nov. 1, 1974

[21] Appl. No.: 520,085

[52] U.S. Cl. ..... 53/11; 53/22 B; 53/110; 53/112 B

[51] Int. Cl.[2] ..... B65B 31/02

[58] Field of Search ..... 53/11, 22 B, 110, 112 B

[56] References Cited

UNITED STATES PATENTS

| | | | |
|---|---|---|---|
| 2,311,707 | 2/1943 | Stewart | 53/11 X |
| 2,420,763 | 5/1947 | Wells | 53/388 |
| 2,869,301 | 1/1959 | Stover | 53/11 X |
| 3,619,975 | 11/1971 | Johnson et al. | 53/110 X |
| 3,813,847 | 6/1974 | Kühnle | 53/112 B |
| 3,861,116 | 1/1975 | Domke | 53/110 |
| 3,871,157 | 3/1975 | Domke et al. | 53/110 |

*Primary Examiner*—Travis S. McGehee

*Attorney, Agent, or Firm*—R. S. Kelly; A. J. Moore; C. E. Tripp

[57] ABSTRACT

A method and apparatus is disclosed for purging air from the headspace of filled flexible containers and from the interstices in the product when the containers are filled with particulates. The method includes the steps of moving the upper open end of the containers through a steam tunnel while directing a flow of low velocity steam within the range of about 0.5 to 5 feet per second into and around the open ends of the containers to purge air therefrom. When air is entrained in a particulate product in the container, the low velocity steam cooperates with a jet of high velocity steam, within the velocity range of about 5 to 20 ft./sec., that is directed into the product for purging both the interstitial air and the headspace air from the container or pouch. In one embodiment of the invention a baffle is disposed above the open end of each particulate filled container to direct the steam-air mixture transversely out of the container for entrainment and flushing to the atmosphere by the low velocity steam. After purging, the open end of the container is closed and sealed while in a steam environment.

16 Claims, 8 Drawing Figures

SCS
SS
PS
FS
LS
HP
LP

FIG_3
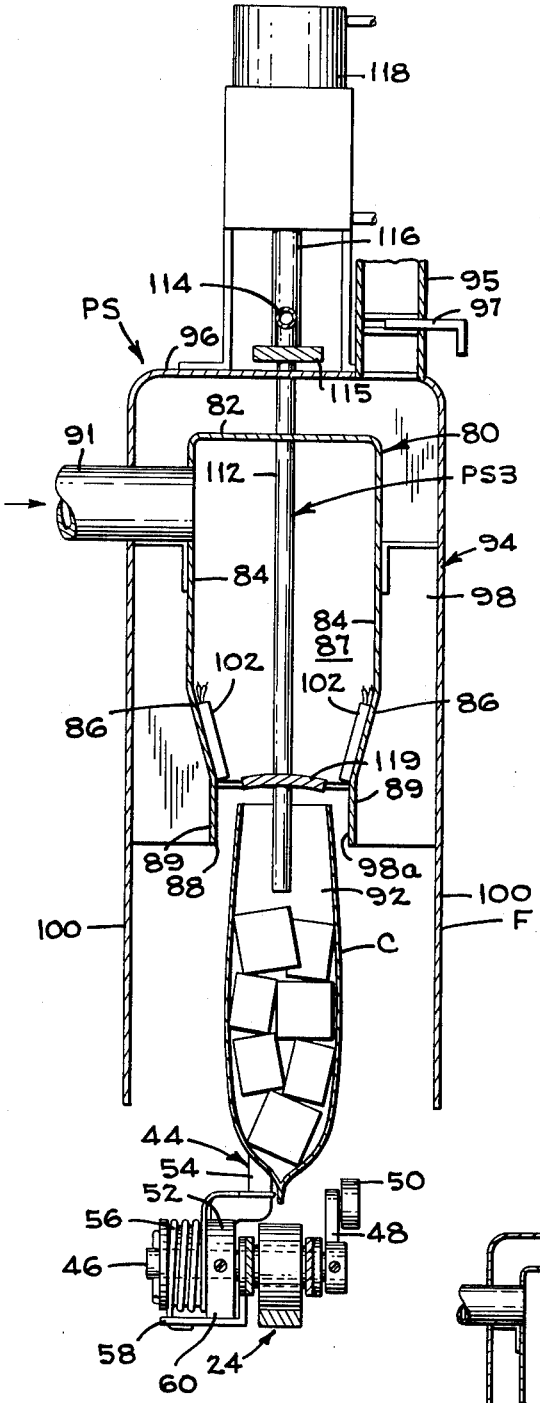
FIG_4
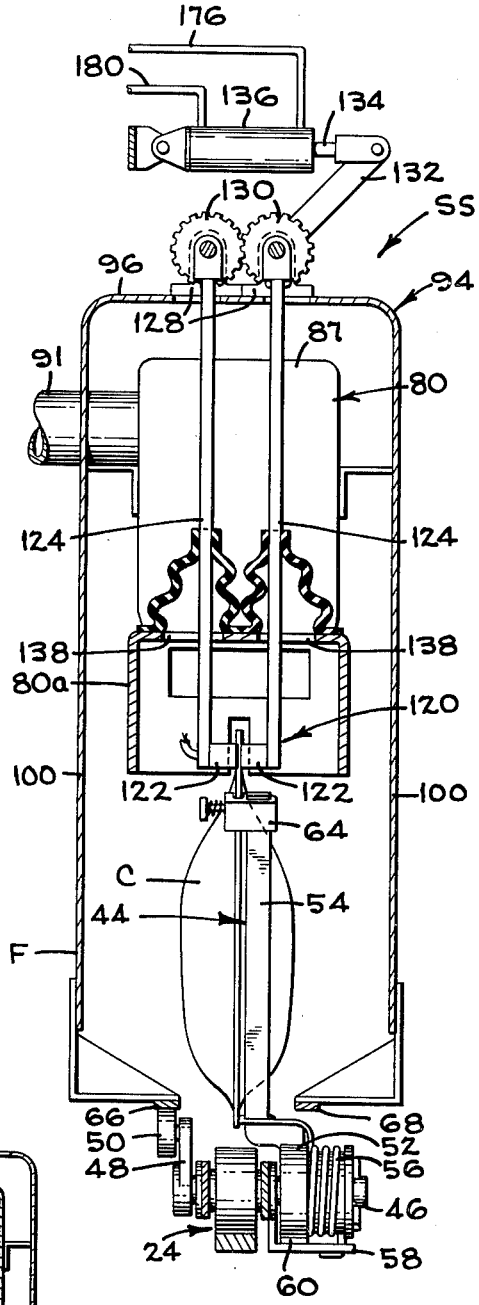
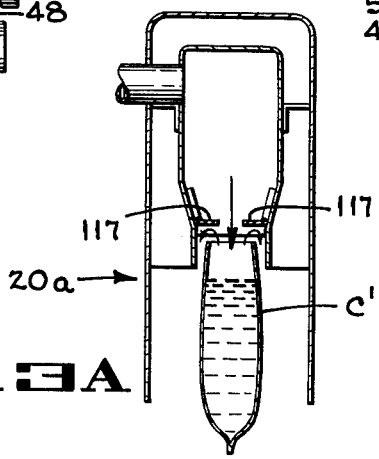
FIG_3A

METHOD AND APPARATUS FOR PURGING AIR FROM CONTAINERS

BACKGROUND OF THE INVENTION

1. Field of the Invention

The present invention pertains to the processing of product filled containers and more particularly relates to a method and apparatus for purging air from product filled containers prior to the sealing thereof.

2. Description of the Prior Art

It is well known in the art to purge air and cooking gases from flexible containers having their upper ends closed, but not sealed, by moving the containers alternately through steam and water baths during processing thereby progressively forcing the noncondensible gases out of the containers before sealing the containers. Wilson U.S. Pat. No. 3,501,318, which issued on Mar. 17, 1970, and is incorporated by reference herein, discloses such a process.

The patent to White U.S. Pat. No. 1,920,539, which issued on Aug. 1, 1933, discloses a method wherein filled rigid containers, and separate caps, are passed through a steam zone at 212° F for the purpose of replacing the air in the headspace of the containers and the caps with steam. While the cap is being sealed on the container, the container is said to be moved to a cooler zone so that the steam in the headspace condenses thereby reducing the internal pressure below atmospheric pressure.

SUMMARY OF THE INVENTION

The method and apparatus of the present invention for purging air from filled containers, when the tops of the containers are open, are effective to reduce the air within the containers to a very low and acceptable level. Containers filled with a non-particulate (e.g., a liquid) product having substantially no air entrained therein require only that the air in the headspace above the product be purged therefrom. It has been found that when the open ends of the containers are moved through a tunnel wherein a steam atmosphere is continuously maintained and when a jet of steam is caused to flow into the open ends of the containers with a velocity sufficient to reach substantially to the lowermost air pockets in said container (whether such air pockets comprise the headspace or the interstitial areas within the product) with the cross-sectional area of the steam nozzle from which the jet is discharged being substantially smaller than the cross-sectional area of the open end of the container to allow a path for the steam-air mixture to flow upwardly from the headspace of the container, then the air can be purged effectively from the container.

When a container is filled with certain particulate products having a significant amount of interstitial air within the product plus headspace air above the product, it has been found to be useful to direct a flow of low velocity steam around the open ends of the containers and a high velocity jet of stream (with a velocity in the range of from about 5 to about 20 ft/sec.) into the product in order to purge the interstitial air therefrom.

After the air has been purged from the flexible containers, the open top of each container may be closed and the container may be sealed while it is still subjected to an atmosphere of steam.

BRIEF DESCRIPTION OF THE DRAWINGS

FIG. 3 is an enlarged transverse section of the purging apparatus, taken along lines 3—3 of FIG. 2, and illustrating the apparatus with a high velocity steam jet system used primarily with containers filled with a particulate product.

FIG. 3A is a reduced transverse section similar to FIG. 3 but illustrating a modified form of the invention without the high velocity steam jet for use with containers filled with products having no air entrained therein.

FIG. 4 is an enlarged transverse section taken along lines 4—4 of FIG. 2 illustrating the flexible containers being sealed in a steam atmosphere.

DESCRIPTION OF THE PREFERRED EMBODIMENT

Figures 1, 5, 6, 7:
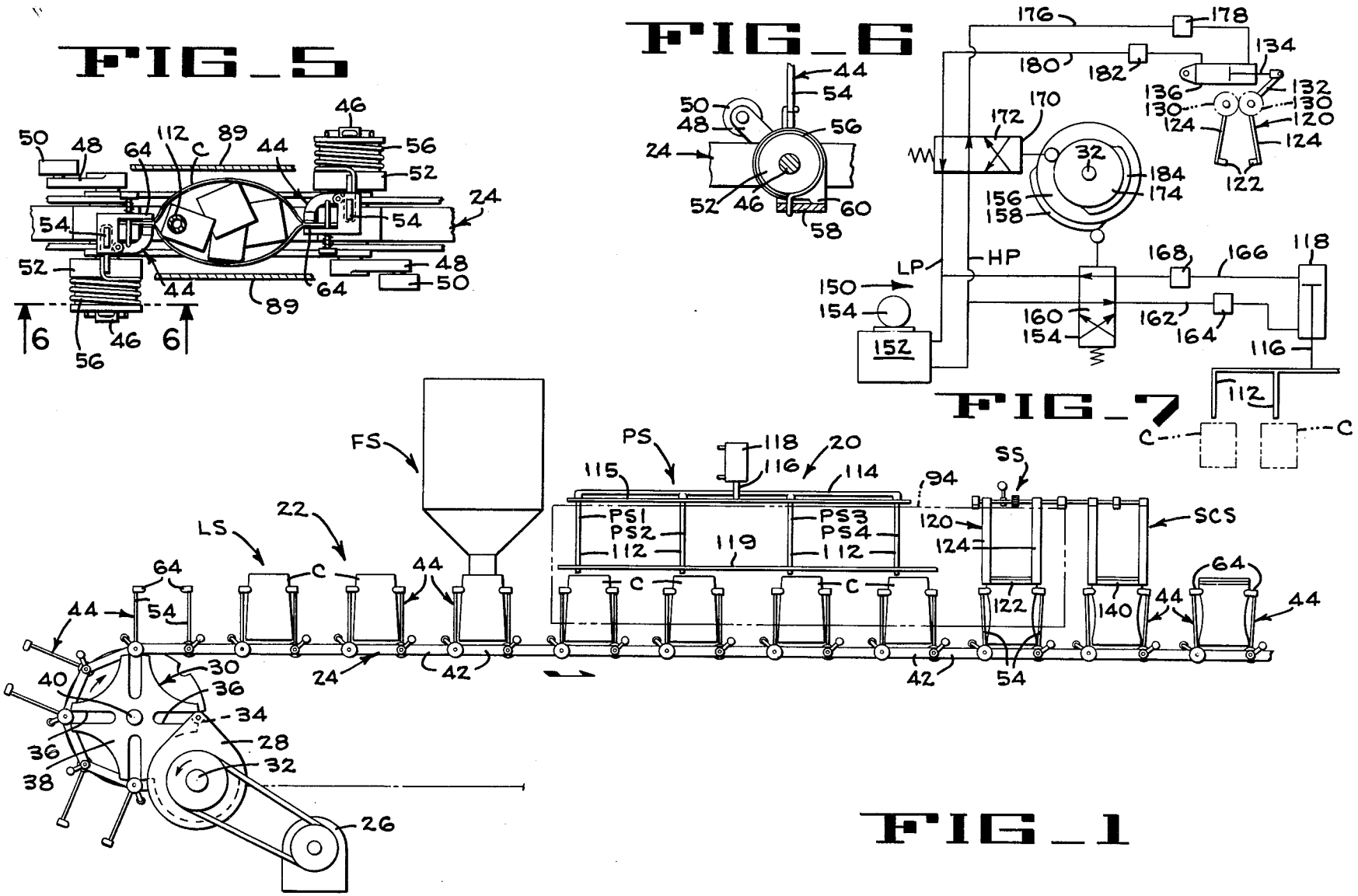
FIG. 1 is a diagrammatic elevation of a portion of a machine for filling and sealing flexible containers with the air purging apparatus of the present invention incorporated therein.
FIG. 5 is an enlarged horizontal section taken along lines 5—5 of FIG. 2 illustrating the mechanism for supporting a filled flexible container in one of the purging stations with portions of the steam tunnel skirt being cut away.
FIG. 6 is a section taken along lines 6—6 of FIG. 5.
FIG. 7 is a schematic diagram illustrating a hydraulic system for operating the apparatus of the present invention.

The air purging apparatus 20 of the present invention is illustrated in FIG. 1 as being a component of a single lane container handling machine 22 which processes flexible containers C preferably formed from thermosealing materials and having open upper ends. Such containers are better known in the art as pouches. The machine 22 carries the flexible containers C from a container loading station LS, to a filling station FS where they are filled with a product, through one or more air purging stations PS, through a sealing station SS which is incorporated in the air purging station, and through a seal cooling station SCS which cools and sets the heated thermosealing material at the seal area.

Although a single lane container handling machine 22 is illustrated in the preferred embodiment, it will be understood that it is within the scope of the invention to use multi-lane machines.

As illustrated in FIG. 1, an endless conveyor 24 is intermittently driven by a motor 26 that is connected to the driving element 28 of a standard, wellknown Geneva drive 30. The driving element 28 is keyed to a continuously driven shaft 32 and includes a cam follower 34 which rides in grooves 36 of the driven element 38 of the Geneva drive. The driven element 38 is keyed to the drive shaft 40 of conveyor 24 and indexes the conveyor 24 in 90° increments, which in the preferred embodiment moves the conveyor in increments equal to the length of two links 42 of the conveyor 24 and at a rate of between 15–40 containers per minute depending upon the time required for sealing the containers.

In order to support the containers C on the conveyor 24, every second link includes a pair of container clamping devices 44 that are identical but oriented on opposite sides of the conveyor as clearly illustrated in FIG. 5. Each device 44 includes a pivot pin 46 (FIGS.

3, 5 and 6) journaled in a sleeve that pivotally connects one link to the adjacent link. A lever 48 having a cam follower 50 journaled thereon is secured to one end of the pin 46, and a hub 52 having an elongated upwardly extending spring finger 54 rigid therewith is secured to the pivot pin 46 on the other side of the conveyor 24. A torsion spring 56 is connected between the hub 52 and an outwardly bent ear 58 (FIG. 6) of the adjacent conveyor link and is held in position around the cylindrical portion of the hub 52 by a washer and cotter pin. As best illustrated in FIGS. 5 and 6, the torsion springs 56 of adjacent devices 44 urge the spring fingers 54 toward each other to normally hold the supported flexible containers C in an open position. An abutment stop 60 on each hub 52 engages the associated link ear 58 to limit the amount of inward pivotal movement of the spring fingers 54.

A container clamping device 64 (FIG. 5) is rigidly secured near the upper end of each spring finger 54 for firm clamping engagement with the associated flexible container. The clamping device 64 are preferably of the type disclosed and claimed in Wilson U.S. Pat. No. 3,763,524 which issued on Oct. 9, 1973 and is assigned to the assignee of the present invention. The disclosure of this Wilson patent is incorporated herein by reference.

Figure 2:
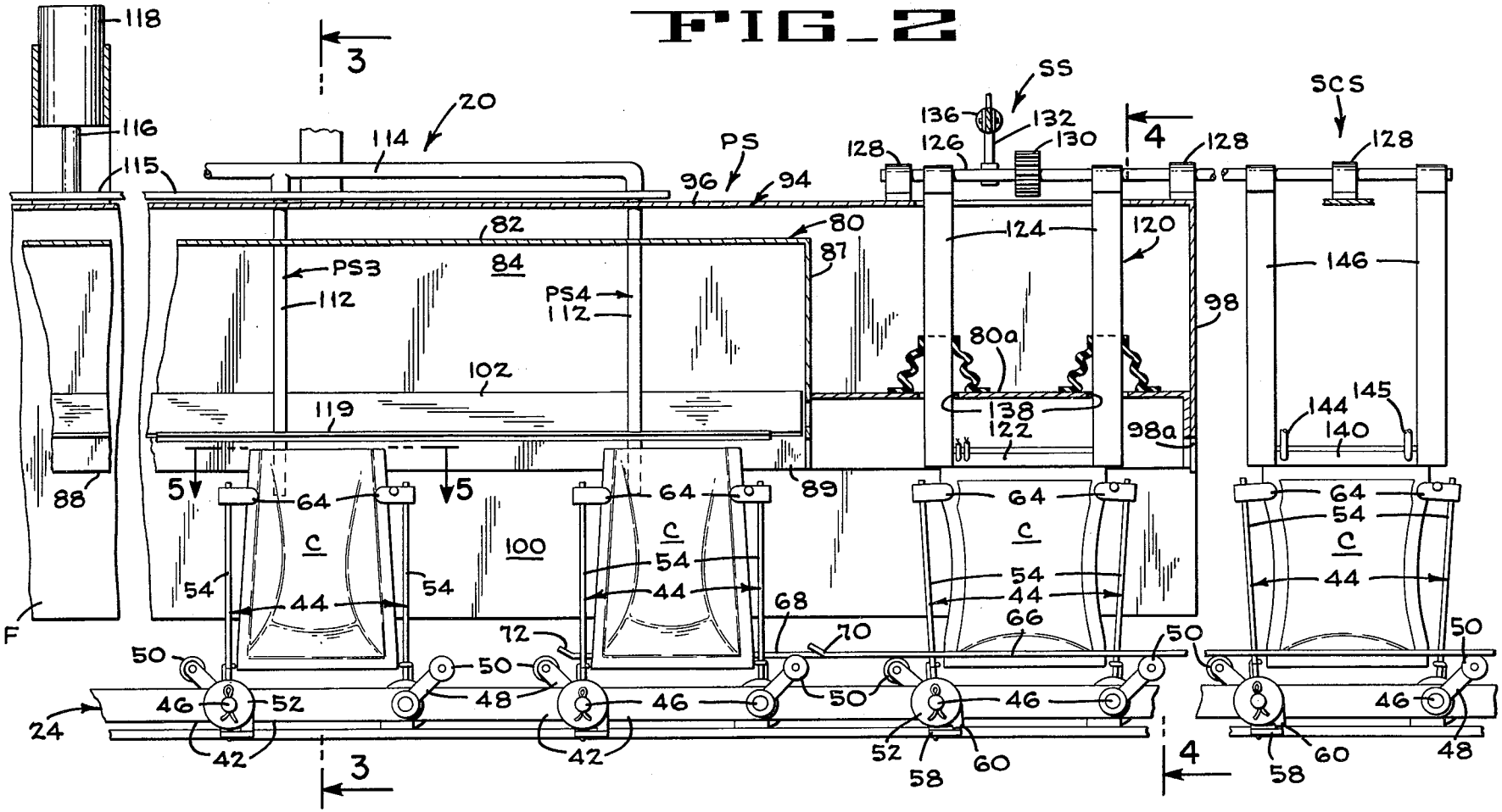
FIG. 2 is an enlarged vertical central section of the air purging and container sealing apparatus.

As illustrated in FIGS. 2 and 4, spaced cam tracks 66 and 68 are fixed to the frame F of the machine 22 on opposite sides of the centerline of the conveyor 24. The inlet ends 70 and 72 (FIG. 2) of the tracks 66 and 68 are positioned immediately downstream of the last purging station so that movement out of the station will cause the cam followers 50 to engage the associated tracks 66 and 68 and urge the spring fingers 54 to a position which applies a tensioning force to the open end of the containers C to form a one-way valve therein as defined and claimed in Wilson U.S. Pat. No. 3,501,318. With the open end of the container closed in this way, gases may escape from the closed container but are prevented from entering the container.

As illustrated in FIGS. 1–3, the air purging apparatus 20 of the present invention includes one or more purging stations PS, four purging stations PS1-PS4 being illustrated in FIG. 1. The number of stations required depends upon the type of product in the flexible container, the size of the container, and the degree of air evacuation required for the specific product.

The purging apparatus 20 comprises an inner housing or steam tunnel 80 having a roof 82, sidewalls 84 with converging lower ends 86, end walls 87 and a lower open end 88 that is preferably about 1½ inches wide and is disposed about the path of movement of the top of the containers. A feature of the invention is the provision of skirts 89 which define the open bottom 88 of the tunnel and project downwardly alongside the containers so that the open upper ends of the containers move through the steam tunnel 80. Low velocity, substantially air free steam is directed through conduit 91 into the tunnel 80 near the downstream end thereof for flow out of the lower end 88 of the tunnel 80 at a velocity of between about 0.5 to 5 ft/sec. Thus, the upper open end of each container is disposed within an atmosphere or tunnel of substantially pure steam which is maintained by causing the steam to flow downwardly transversely to the direction of movement of the containers and out the bottom of the tunnel. The steam is guided downwardly under plug flow conditions by the skirts 89 into the headspace 92 of each container as well as around the outside of the container.

In order to prevent cooling of the tunnel 80, an outer housing 94 is formed around the tunnel 80. The outer housing includes a roof 96, end walls 98 which project downwardly to the lower edge of the steam tunnel and which include slots **98*a* (FIGS. 2 and 3) to permit passage of the containers C, and side walls 100 which project downwardly to a point near the lower ends of the containers. A venting chimney 95 (FIG. 3) is provided in the roof 96 of the tunnel and includes a slide valve 97** to control the amount of steam present in the outer housing during operation of the apparatus.

The low velocity steam may, if desired, be superheated by heating bars 102 that are mounted in the tunnel 80. The heating bars 102 are preferably electrically heated and are raised to a temperature up to about 550° F thus superheating the steam to minimize formation of condensate on the product.

When the containers are filled with certain particulate products, it has been found to be desirable to direct a jet of high velocity steam into the product in addition to the low velocity steam from the tunnel in order to purge the interstitial air from between the particles in the containers.

As indicated in FIG. 1, each of the purging stations PS1-PS4 includes a high velocity steam nozzle 112 which projects downwardly through steam tunnel 80 and outer housing 94 and into the headspace 92 of the associated container during purging. Each steam nozzle 112 is about ¼ inch in diameter and is connected to a manifold 114 that is connected to a source of steam under pressure which is adapted to cause the stream to flow from the nozzle 112 at a velocity within the range of about 5 to 20 ft./second. The nozzles 112 and manifold 114 are supported by a carriage 115 connected to the piston rod 116 of a hydraulic or pneumatic cylinder 118. The cylinder 118 is supported by the frame F and serves to raise the nozzles 112 above the containers, as illustrated in FIG. 1, when the conveyor 24 moves the containers between stations. After a container is indexed at a purging station, the hydraulic cylinder 118 lowers the discharge end of the associated nozzle into the container to a depth of about 1 inch or lower for purging air from the container and the product therein.

In the embodiment of the invention illustrated in FIG. 3, a baffle plate 119 is secured to the nozzle 112 and is disposed immediately above the open end of the container to cause the steam-air mixture to flow laterally outward of the container headspace. The steam-air mixture is then entrained by the low velocity steam in the tunnel 80 and is moved downward and out into the housing 94.

As mentioned previously, when the container C is filled with a product which completely fills the container except for headspace air thereabove, i.e., a filled container having very little or no interstitial air therein, the high velocity steam system incorporated in FIG. 3 is not believed to be required. FIG. 3A illustrates a purging apparatus **20*a* that is substantially identical to the apparatus of FIG. 3 except that the high velocity steam jet system has been removed therefrom and the container C′ is filled with liquid or the like. Also, baffle plates 117** are secured to the inner walls of the tunnel to block the direct application of the moving stream of steam to a portion of the container to provide an avenue for the purged air to escape.

After the air has been purged from the container C at purging station PS-4 (FIG. 2), the conveyor 24 moves the container to the sealing station SS during which time the mouth or top of the container is closed by engagement of the cam followers 50 (FIG. 2) of the associated container clamping devices 44 with the tracks 66 and 68. When at the sealing station SS, the container C is sealed by a conventional heat sealer 120 that is disposed within the steam atmosphere in a shallow tunnel 80*a* which is connected to and forms an extension of the steam tunnel 80.

The heat sealer 120 (FIGS. 2 and 4) preferably includes a pair of jaws 122 supported by arms 124 secured to shafts 126. The shafts 126 are journaled by bearings 128 to the frame F and have meshing pinion gears 130 keyed thereto. A lever 132 is rigidly secured to one of the shafts and is pivotally connected to the piston rod 134 of a fluid cylinder 136 that is pivoted to a portion of the frame F. Retraction of the piston rod 134 separates the jaws 122 from each other, while extension of the piston rod applies a sealing pressure of about 40 pounds per square inch to the seal area for about 0.5 seconds at a temperature of about 400°–500° F. Apertures 138 are provided in the roof of the extension tunnel 80*a* and bellows-type diaphragms are provided to permit the arms 124 to operate within the steam-filled tunnel 80*a*.

After sealing, the conveyor 24 advances the sealed container into the seal cooling station SCS outside of the housing 94 at which time the seal area is cooled and set by cooling jaws 140 (only one jaw being shown in FIG. 2). The jaws 140 are similar to the sealing jaws except that they include flow passages for cooling water flowing between conduits 144 and 145. The cooling jaws 140 are illustrated as being connected to the shafts 126 by arms 146; however, it will be understood that a separate cylinder and jaw actuating mechanism may be employed for actuating the cooling jaws 140. A force of about 200 psi to the seal area for a period of about 1 second is believed to be sufficient to cool and set the thermosealing material.

A hydraulic control system 150 is diagrammatically illustrated in FIG. 7 for raising and lowering the high velocity steam nozzle 112 and for opening and closing the sealing jaws 122 and the cooling jaws 140 in timed relation with the intermittent movement of the conveyor 24 (FIG. 1). When the components of the Geneva drive 30 are positioned to start an indexing movement of the conveyor 24 as indicated in FIG. 1, the nozzles 112 are raised above the containers and the sealing and cooling jaws are open.

As illustrated in FIG. 7, the hydraulic control system 150 includes a pump 152 which is driven by a motor 154 to direct high pressure fluid through main high pressure conduit HP and to receive the low pressure fluid from conduit LP. A steam nozzle control valve 154 is actuated by a cam 156 which is secured to the Geneva drive shaft 32 and includes a lobe 158 that extends over an arcuate range of slightly in excess of 90°. When positioned on the lobe 158 as indicated in FIG. 7, fluid flows through parallel passages in a valve core 160 in the direction indicated by the arrows. High pressure fluid flows through a conduit 162 and speed control valve 164 into the cylinder 118 thus raising the nozzles 112. Low pressure fluid returns to the pump 152 through conduit 166, speed control valve 168, valve 154 and low pressure conduit LP.

When the valve core 160 has moved off the lobe 158 the fluid reverses its direction of movement by flowing through cross passages formed in the periphery of the core 160 thus lowering the nozzles into the containers.

Similarly, the sealing and cooling hydraulic cylinder 136 is controlled by a valve 170 that includes a core 172 having parallel passages and cross passages therein. The core 172 is shifted by a cam 174 secured to the shaft 32 and disposed in a plane spaced from the cam 156. The cam 174 includes a small diameter portion which maintains the core 172 in its parallel passage portion until after the conveyor has stopped movement. During this time high pressure fluid is directed through conduit 176 and speed control valve 178 to retract the piston 134 in the cylinder 136 thereby opening the sealing and cooling jaws. Low pressure fluid is returned to the pump 152 through conduit 180, speed control valve 182, the valve 170 and low pressure lines LP.

The cam 174 also includes a lobe 184 which shifts the valve core 172 to the cross passage position thereby reversing the direction of flow to the cylinder 136 and closing the sealing and cooling jaws. The lobe 184 extends through an arcuate range sufficient to maintain sealing pressure on the containers for the desired sealing time.

From the foregoing description it is apparent that the air purging apparatus and method of the present invention is effective to greatly reduce headspace and interstitial air within containers. If the containers are filled with a product such as a liquid which entrains very little if any air therein, the headspace air may be reduced to an acceptable level merely by moving the open ends of the containers through a tunnel of steam that is directed to flow downwardly into and past the open top of the container in a nonmixing or plug flow pattern. If the containers are filled with a particulate product, a nozzle can be used to directly inject steam into the container at a velocity sufficient to penetrate the product for the requisite distance. This nozzle may move only into the headspace of the container or it may be moved directly into the product itself if necessary and feasible.

Although the best modes contemplated for carrying out the present invention have been herein shown and described, it will be apparent that modification and variation may be made without departing from what is regarded to be the subject matter of the invention.

What is claimed is:

1. Apparatus for purging air from a product filled container having an open end comprising an open-bottomed steam tunnel, means for directing a stream of steam downwardly along the outside of said container within said tunnel, means for conveying a container along a path parallel to said tunnel with said open end of the container being received in the tunnel, and a steam nozzle provided in said tunnel for directing a jet of steam downwardly into said container at or near the open end of said container, said nozzle having a cross-sectional area which is substantially smaller than the area of said open end of said container, said jet having a velocity greater than said stream of steam sufficient to reach substantially to the lowermost air pockets in said container, the smaller area of said nozzle relative to the larger cross-sectional area of said container providing a path for air to escape from said container into said stream of steam for movement downwardly therewith.

2. Apparatus according to claim 1 wherein said tunnel is oriented in a generally horizontal plane and wherein the open bottom thereof is defined by a pair of skirt portions which are closely spaced from the side edges of said container.

3. Apparatus according to claim 2 wherein said tunnel is comprised of longitudinally extending side walls which are inclined inwardly toward each other near the bottom of the tunnel to provide a restricted exit passage for the steam within the tunnel.

4. Apparatus according to claim 1 including means for moving said nozzle into and out of said container, and means for delivering a jet of steam from said nozzle when said nozzle is in said container.

5. Apparatus according to claim 1 including a housing surrounding and spaced from said steam tunnel for receiving the steam from said tunnel and the air purged from said container and for directing said steam and air away from said tunnel.

6. A method of purging air from a filled container having an open top comprising the steps of forming and maintaining an open-bottomed tunnel of flowing steam with the steam flowing out of said tunnel through the bottom thereof at a low velocity in the range of from about 0.5 to about 5 ft./sec., moving the open top of the container in a path through said steam flowing out of the tunnel and in a direction transverse to the direction of flow of said steam, directing a jet of steam at a high velocity within the range of about 5 to 20 ft./sec. into the container to assist the low velocity steam in purging air from the container, releasing the jet of high velocity steam from confinement at a location within the container below the upper end thereof, baffling the area directly above and slightly spaced from the open upper end of the container for controlling the flow of the mixture of steam and air out of the open end of the container by causing the steam-air mixture to flow transversely outwardly of the container, and directing the flow of low velocity steam from the tunnel of steam downwardly for entraining the steam-air mixture and drawing the mixture away from the open end of the container and out of the bottom of the tunnel.

7. An apparatus for purging air from a filled container having an open top and headspace comprising; means defining an open-bottomed steam tunnel, means for directing a supply of flowing steam into said tunnel and out the open bottom thereof, conveying means for conveying the container below said tunnel with the open top passing through said tunnel in the flow path of steam within said tunnel, means for directing a jet of steam into the container for aiding the purging of air therefrom, baffle means disposed above and spaced from the open top of the container for causing the steam in the container to mix with air therein and flow laterally out of the container as a steam-air mixture and further causing the steam flowing downwardly from the tunnel to entrain the steam-air mixture and direct it away from the container.

8. An apparatus according to claim 7 including housing means having a portion thereof encompassing said steam tunnel for capturing steam discharged from the tunnel.

9. An apparatus according to claim 7 wherein the container is a flexible container formed from thermosealing material and wherein said conveying means moves the container through at least one purging station and a container sealing station in said steam tunnel, container gripping means for maintaining the upper end of the container open when the container is at the purging station and for applying a tensioning force across the open end of the container to close the open end as the container is moved from the purging station into the sealing station, and sealing means for sealing the open end of the container by application of heat and pressure at the sealing station.

10. An apparatus for purging air from filled containers having open tops and headspaces comprising; means defining an open bottom steam tunnel, means for directing a supply of flowing steam into said tunnel and out the open bottom thereof, means for conveying said containers below said tunnel along a path parallel to the longitudinal direction of the tunnel and with the open tops of the containers being received in said tunnel, baffle means spaced above but adjacent to the open tops of said containers and overlying and completely blocking vertical movement of steam or air above at least one lateral side of the open tops of the containers to cause a steam-air mixture to flow transversely outwardly from the tops of said containers at said side thereof, the bottom of said tunnel being defined by closely spaced skirts wherein the open tops of the containers are disposed between and closely spaced adjacent to said skirts for causing the steam to flow at a low velocity in a direction transversely to the direction of movement of the containers and downwardly past the outer surfaces of the containers.

11. An apparatus according to claim 10 including sealing means located within said steam tunnel for sealing the open tops of said containers after the purging of air therefrom by said flowing steam.

12. An apparatus according to claim 10 wherein the low velocity flow of steam is maintained within a range of from about 0.5 to about 5 ft/sec.

13. An apparatus according to claim 10 further comprising housing means which includes a portion encompassing said steam tunnel for capturing steam discharged from said tunnel.

14. Apparatus for purging air from a product-filled container having an open end, the apparatus comprising an open-bottomed steam tunnel, a supply of steam in the tunnel, means for conveying a container along a path parallel to the tunnel with the open end of the container being received in the tunnel, means provided in the tunnel for directing a stream of steam generally downwardly into the open end of the container at or near the open end of said container, said stream of steam prior to engaging the product having a cross-sectional area within said container which is substantially smaller than the area of said open end of said container, said stream having a velocity of at least 0.5 feet per second, and a housing surrounding and spaced from the steam tunnel for receiving steam from the tunnel and air purged from the container and for directing the steam and air thus received away from the tunnel.

15. A method of purging air from an open ended container, the method comprising the steps of maintaining an open bottomed steam tunnel with the steam flowing downward out of said tunnel through the bottom thereof at a velocity of at least 0.5 feet per second, moving the open ended container in a path through the steam in a direction transverse of the flow direction of the steam, baffling the area spaced above but adjacent to the open end of the container to cause the steam-air mixture to flow transversely outwardly from the container, and directing the low velocity steam downwardly for entraining the steam-air mixture to draw the mixture away from the open end of the container and out of the bottom of the tunnel.

16. An apparatus for purging air from filled containers having open tops and headspaces, the apparatus comprising means defining an open bottomed steam tunnel, means providing a supply of steam, means for directing said supply of steam into said tunnel and out the open bottom thereof, means for conveying the containers below said tunnel along a path parallel to the longitudinal direction of the tunnel and with the open tops of the containers being received in said tunnel, baffle means spaced above but adjacent to the open tops of said containers and overlying and completely blocking vertical movement of steam or air above at least one lateral side of the open tops of the containers to cause a steam-air mixture to flow transversely outwardly from the tops of said containers at said side thereof, the bottom of said tunnel being defined by closely spaced skirts between which skirts the open tops of the containers are disposed for causing the steam to flow at a low velocity in a direction downwardly and transversely to the direction of movement of the containers, and housing means including a portion encompassing said steam tunnel for capturing steam discharged from said tunnel.

* * * * *